US006039648A

United States Patent [19]

Guinn et al.

[11] Patent Number: 6,039,648

[45] Date of Patent: Mar. 21, 2000

[54] AUTOMATED TOURNAMENT GAMING SYSTEM: APPARATUS AND METHOD

[75] Inventors: Robert Guinn; David Richards, both of Las Vegas, Nev.

[73] Assignee: Casino Data Systems, Las Vegas, Nev.

[21] Appl. No.: 08/811,551

[22] Filed: Mar. 4, 1997

[51] Int. Cl.[7] ..... A63F 9/22

[52] U.S. Cl. ..... 463/16; 463/20; 273/143 R

[58] Field of Search ..... 463/42, 41, 40, 463/29, 26, 25, 23, 20, 19, 18, 17, 16, 13, 12, 11; 902/23; 340/323 R; 364/411.1, 410.1; 273/143 R

[56] References Cited

U.S. PATENT DOCUMENTS 5,083,271 1/1992 Thacher et al. .
5,259,613 11/1993 Marnell, II .
5,476,259 12/1995 Weingardt .
5,752,882 5/1998 Acres et al. .
5,755,621 5/1998 Marks et al. .
5,779,549 7/1998 Walker et al. .
5,833,540 11/1998 Miodunski et al. ..... 463/42

*Primary Examiner*—Michael O'Neill
*Attorney, Agent, or Firm*—Bernhard Kreten

[57] ABSTRACT

An apparatus and method for an automated tournament gaming system (10) comprising a central server computer (20) operatively coupled to, inter alia, a plurality of gaming machine $G_1$, $G_2$ . . . $G_N$ for automatically harnessing any of the gaming machines for automatically inciting and running a tournament where a group of players are participating for a period after which prizes are awarded to the winning tournament play participants. In addition, the system (10) includes a host site computer (200) operatively coupled to a plurality of the central servers (20) at a variety of remote gaming sites $C_1$, $C_2$ . . . $C_N$ for providing a multi-site progressive automated tournament gaming system (210). The multi-site system (210) is integrated into the system (10) to increase the winnings, progressive amounts and the total buy-ins.

27 Claims, 5 Drawing Sheets

AUTOMATED TOURNAMENT GAMING SYSTEM: APPARATUS AND METHOD

FIELD OF THE INVENTION

The instant invention relates generally to a multiplicity of gaming machines which are automatically harnessed from a central source to incite and run a tournament where upon completion participating individuals are awarded with special prizes.

BACKGROUND OF THE INVENTION

Typically, casinos presently sequester an area containing a plurality of machines for tournament play. The tournament is designated to start at an appointed time, and those players who timely enroll are admitted into the corded off area to begin play with all other entrants. While this system works fairly effectively, in many cases a player who would like to enter the tournament arrives a few minutes late and is either at a disadvantage with respect to the other tournament players or will have been excluded. In addition, the mechanisms associated with enrollment provide down time for the casinos with respect to those games due to, inter alia, the need of the casino to sequester the tournament machines.

Moreover, in some cases the machines that have been allocated for tournament play may be under subscribed for lack of players while other areas immediately adjacent the sequestered area has a greater demand. In addition, many players do not like to stand in line and are required to do so for the enrollment process.

The following prior art reflects the state of the art of which applicant is aware and is included herewith to discharge applicant's acknowledged duty to disclose relevant prior art. It is stipulated, however, that this reference does not teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 5,083,271 | January 21, 1992 | Thacher, et al. |
| 5,476,259 | December 19, 1995 | Weingardt |

SUMMARY OF THE INVENTION

The instant invention is distinguished over the known prior art in a multiplicity of ways. For one thing, any of several machines can be used either for individual gaming or for tournament play based on the desire of the player. This means that each machine can serve a multiple use for either individual play or tournament play.

In addition, the machines do not need to be sequestered into an area although it is desirable to have sufficient signage in the area of tournament play so that all players have a communal sense of the endeavor. A machine enabled by the apparatus according to the instant invention can be approached by a player who will be prompted and notified of an upcoming tournament event. In addition, while the player is playing a non-tournament game, the machine can inform the player of the prize schedule that is associated with tournament play and include a countdown on the amount of time remaining before the tournament begins. In this way, the casino and the player enjoy uninterrupted entertainment immediately prior to the tournament and all machines are at full productivity.

Once the tournament begins, variations of the tournament can include team play, individual play and the like so that various groups (such as conventioneers) can be teamed up for communal efforts or there can be a form of competition to stimulate the gaming experience.

OBJECTS OF THE INVENTION

Accordingly, it is an object of the instant invention to provide a new and novel automated tournament gaming system: apparatus and method.

A further object of the instant invention is to provide a real time automated tournament gaming system which harnesses a multiplicity of gaming machines from a central source.

Another further object of the instant invention is to provide a system as characterized above which provides means for real time tournament play and data collection and accessibility of information by continually moving through the system via real time polling means.

Another further object of the instant invention is to provide a system as characterized above which interfaces with a variety of different manufacturs' makes and models of gaming machines.

A further object of the instant invention is to provide a system as characterized above which includes a real-time accounting and information system comprised of a player data base, a player tracking module and a pit, cage and credit module.

Another further object of the instant invention is to provide a system as characterized above which includes a plurality of gaming machines which can be used either for individual gaming play or tournament gaming play based on the desire of the player thereby allowing each gaming machine to serve a multiple use for either individual play or tournament play.

Another further object of the instant invention is to provide a system as characterized above which includes means for sequestering a plurality of gaming machines scattered throughout a casino.

Another further object of the instant invention is to provide a system as characterized above which allows a player at each gaming machine to automatically enroll through the gaming machine being played and to continue normal game play up to the start of the tournament thereby allowing all machines to operate at full productivity.

Another further object of the instant invention is to provide a system as characterized above which allows variations of the tournament play which can include team play, individual play and the like so that various groups, such as conventioneers can be teamed up for communal efforts or there can be a form of competition to stimulate the gaming experience.

Another further object of the instant invention is to provide each of the plurality of gaming machines with a display means for displaying a dynamically changing pay table between a normal mode and a tournament incentive mode.

Another further object of the instant invention is to provide a system as characterized above wherein each gaming machine includes a display means for displaying tournament information including video attract sequences, tournament start time and tournament options.

Another further object of the instant invention is to provide a system as characterized above wherein each gaming machine includes memory means for storing scripts of information for displaying the video attract sequences, the tournament start times and the tournament options.

Another further object of the instant invention is to provide a system as characterized above which includes a countdown timer means for dynamically displaying a countdown of the time remaining until the tournament starts.

Another further object of the instant invention is to provide a system as characterized above which includes means for retrieving different attract sequence scripts either locally or remotely wherein said different sequence scripts are maintained by a central server and/or gaming device.

Another further object of the instant invention is to provide as characterized above which includes a host site computer operatively coupled to a plurality of gaming machines at a variety of independent remote gaming locations, for example, casino sites thereby providing a progressive automated tournament gaming system: apparatus and method according to one form of the instant invention.

Viewed from a first vantage point it is an object of the instant invention to provide an apparatus for tournament play for a plurality of gaming machines, comprising, in combination: a controller, a processor, means coupling the processor and controller to the plurality of gaming machines, means for prompting potential players of the inception of a tournament, and means for enabling the plurality of machines to assume a tournament mode.

Viewed from a second vantage point it is an object of the instant invention to provide a method for tournament play, the steps including: prompting players of an upcoming tournament; enrolling tournament players; sequestering gaming machines selected by enrolled players for the tournament by converting the machine to tournament status; playing the tournament; concluding the tournament; awarding prizes, and preventing the gaming machine from accepting tournament status.

These and other objects will be made manifest when considering the following detailed specification when taken in conjunction with the appended drawing figures.

DESCRIPTION OF PREFERRED EMBODIMENTS

Figure 1:
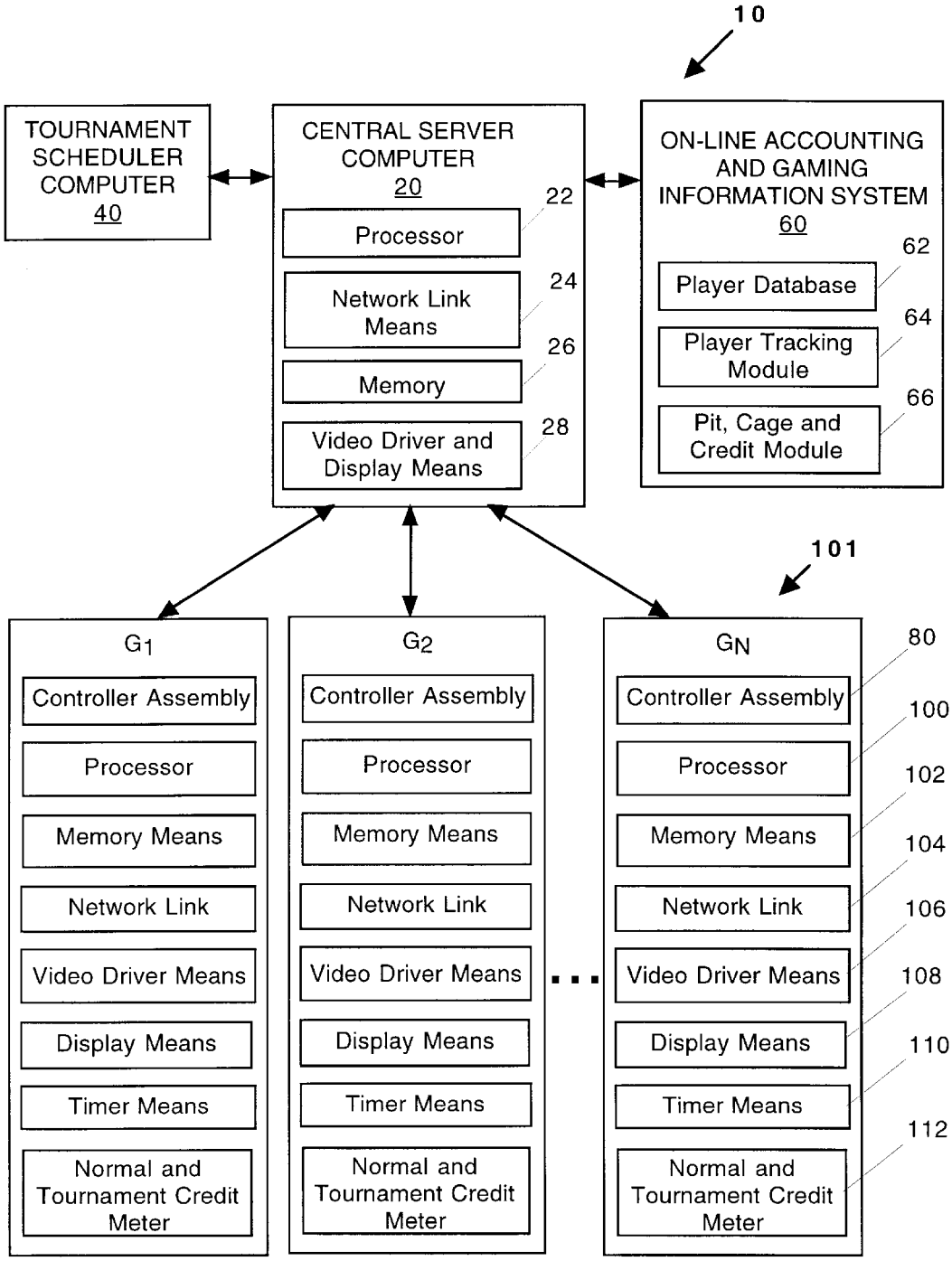
FIG. 1 is a schematic depiction of the invention according to one form.

Considering the drawings, wherein like reference numerals denote like parts throughout the various drawing figures, reference numeral 10 is directed to an automated tournament gaming system according to the instant invention.

Figure 2:
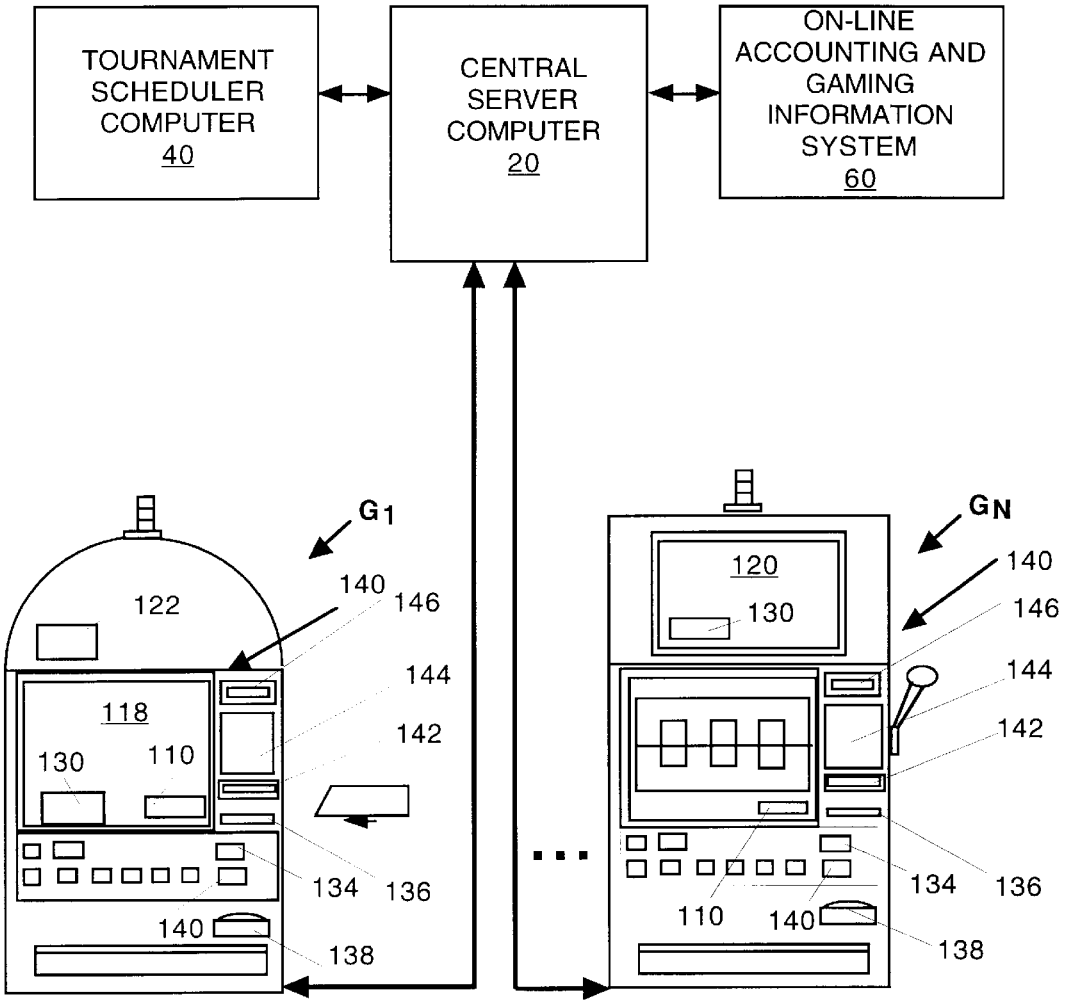
FIG. 2 is a schematic depiction of the invention according to one form and further detailing a plurality of gaming machines.

In essence, and referring to FIGS. 1 and 2, the automated tournament gaming system 10 includes a central server computer 20 operatively coupled to, inter alia, a plurality of gaming machine $G_1$, $G_2$ . . . $G_N$ which may include both electronic and reel type slot machines. The central server computer 20 automatically harnesses a multiplicity of gaming machines $G_1$, $G_2$ . . . $G_N$ to incite and run a tournament where a group of players are participating for an interval after which prizes are awarded to the winning tournament play participant(s). In addition, and referring to FIG. 3, the system 10 includes a host site computer 200 operatively coupled to a plurality of the central servers 20 at a variety of remote gaming sites $C_1$, $C_2$ . . . $C_N$ for providing a multi-site progressive automated tournament gaming system 210. The multi-site system 210 is integrated into the system 10 to increase the winnings, progressive amounts and the total buy-in.

More specifically, and referring to FIGS. 1 and 2, the automated tournament gaming system 10 includes, inter alia, a central server computer 20, a tournament schedule computer 40 and a plurality of gaming machines $G_1$, $G_2$ . . . $G_N$. Each gaming machine $G_N$ includes a controller assembly 80 operatively coupled to the central server computer 20 and is comprised of a micro controller unit designed to monitor multiple signals from each individual gaming machine $G_N$. In addition, the assembly 80 includes an interface board fitted with appropriate electronics for each specific make and model of each individual gaming machine $G_N$. One example of the controller assembly 80 is commercially available under the name "SENTINEL II" manufactured by applicant.

In addition, each gaming machine $G_N$ includes a processor assembly 100 operatively coupled to the central server computer 20 and the controller assembly 80. The processor assembly 100 includes a processor means 101, a memory means 102, a network link 104 and a video driver means 106. The video driver means 106 is operatively coupled to at least one display means 108. A touch screen display may be employed as the display means 108. Moreover, each gaming machine preferably includes a timer means 110 for dynamically displaying time to a player and a normal/tournament credit meter 112 for displaying normal and tournament credits to the player. The processor assembly 100 communicates with the central server 20 and the gaming machine $G_N$, indicating who is in the top positions, what the payout schedules are, and what the progressive amount is.

Referring to FIG. 2, in electronic video games, the video driver means 106 is operatively coupled to at least one video display means 118 and sequesters a portion of the video display means 118 for displaying video attract sequences, tournament start times and tournament option. Where the system includes the reel type slot machines the video driver means 106 is operatively coupled to at least one active display means 120 so that the player receives a clear indication of attract sequences, tournament start times and tournament options. The gaming machines $G_1$, $G_2$ . . . $G_N$ may also be provided with a second video display 122 as an alternative to sequestering a portion of the gaming display monitor for displaying video attract sequences, tournament start times and tournament options. In addition, the video driver means 106 includes sound generating means for producing attractive sounds at each gaming machine $G_N$ which are orchestrated with the video sequences.

The attractive multimedia video displays and dynamic sounds are provided by the system 10 by using multimedia extensions thereby allowing gaming machines $G_1$, $G_2$ . . . $G_N$ to display full-motion video animation with sound to attract players to the machines. During idle periods, the gaming machines preferably display a sequence of attraction messages in sight and sound. The videos may also be used to market specific areas of the casino and may be customized to any needs.

Furthermore, the automated tournament gaming system 10 includes a the tournament schedule computer 40 operatively coupled to the central server 20 for scheduling tournament parameters such as the length of tournaments, paytables and start times. The system parameters are preferably input into the system 10 by an operator with the proper authority access. Preferably, the tournament schedule computer 40 displays a set up screen on an associated monitor which includes the following fields: number of minutes for attract/tournament sign up, number of minutes for displaying winners, tournament start and end times and tournament buy in. Any number of tournaments can be defined each day via the tournament schedule computer 40. Preferably, for ease of entry, the system 10 allows for holidays and special events and the corresponding holidays and special events are preferably input into the system 10 via a calendar interface so that the operator can set up events clearly.

The input set up screen of the tournament scheduler computer 40 also includes means for defining a percentage of the buy in which will go to a first place winner, a second place winner, a third place winner, a fourth place winner, etc. In addition, the input set up screen of the tournament scheduler computer 40 preferably includes a field for entering a percentage of participants which are to receive a pay out and also any remaining number of winners. Preferably these two parameters can be an either or option where the number of places is defined by a percentage of participants or by a set number. The input set up screen also includes a field for entering the remaining percentage of the buy in which will be allocated to all winners. Preferably the above input for tournaments would automatically place all percentages at a maximum percent defined by the casino.

For example, assume that a typical tournament at the casino is composed of 200 games, and 50% or 100 games participate, and the Buy-In is $100, a total of $10,000 is generated from the tournament. The pay schedule could be composed as follows:

| | | |
|---|---|---|
| Total Payout: | $10,000 | |
| Top award: | $4,000 | 40% |
| Second: | $2,000 | 20% |
| Third: | $1,000 | 10% |
| Fourth through 8th | $1,000 | 10% |
| $2.30 times 100 = | $230 | (A $2.30 normal casino game hold per game) |
| Supplier Operator Fee | $500 | 5% |
| Additional Win for the casino | $1,270 | |
| 552% increase from normal play (Additional Win vs. Average Hold) | | |

In another example assume that the tournament is composed of 200 games, and 50% or 100 games participate, and the Buy-In is $40, a total of $4,000 is generated from the tournament. The pay schedule could be composed as follows:

| | | |
|---|---|---|
| Total Payout: | $4,000 | |
| Top award: | $1,200 | 40% |
| Second: | $800 | 20% |
| Third: | $400 | 10% |
| Fourth through 8th | $400 | 10% ($80 per winner) |
| $2.30 time 100 = | $230 | |
| Casino Operator Fee | $200 | 5% |
| Additional Win for the Casino | $770 | |
| 334% increase from normal play (Additional Win vs. Average Hold) | | |

In a further example assume that the tournament is composed of 200 games, and 50% or 100 games participate, and the Buy-In is $20, a total of $2,000 is generated from the tournament. The pay schedule could be composed as follows:

| | | |
|---|---|---|
| Total Payout: | $2,000 | |
| Top award: | $800 | 40% |
| Second: | $400 | 20% |
| Third: | $200 | 10% |
| Fourth through 8th | $200 | 10% ($40 per winner) |
| $2.30 times 100 = | $230 | |
| Casino Operator Fee | $100 | 5% |
| Additional Win for the casino | $70 | |
| 30% increase from normal play (Additional Win vs. Average Hold) | | |

Preferably, the system 10 further includes a real-time or on-line accounting and gaming information system 60 operatively coupled to the central server computer 20. The accounting and gaming information system 60 includes a player database 62 for storing player profiles, a player tracking module 64 for tracking players and a pit, cage and credit system 66 for providing automated casino transactions. One example of the real-time accounting and game information system 60 and its associated modules is commercially available under the name "OASIS II" manufactured by applicant.

Figure 3:
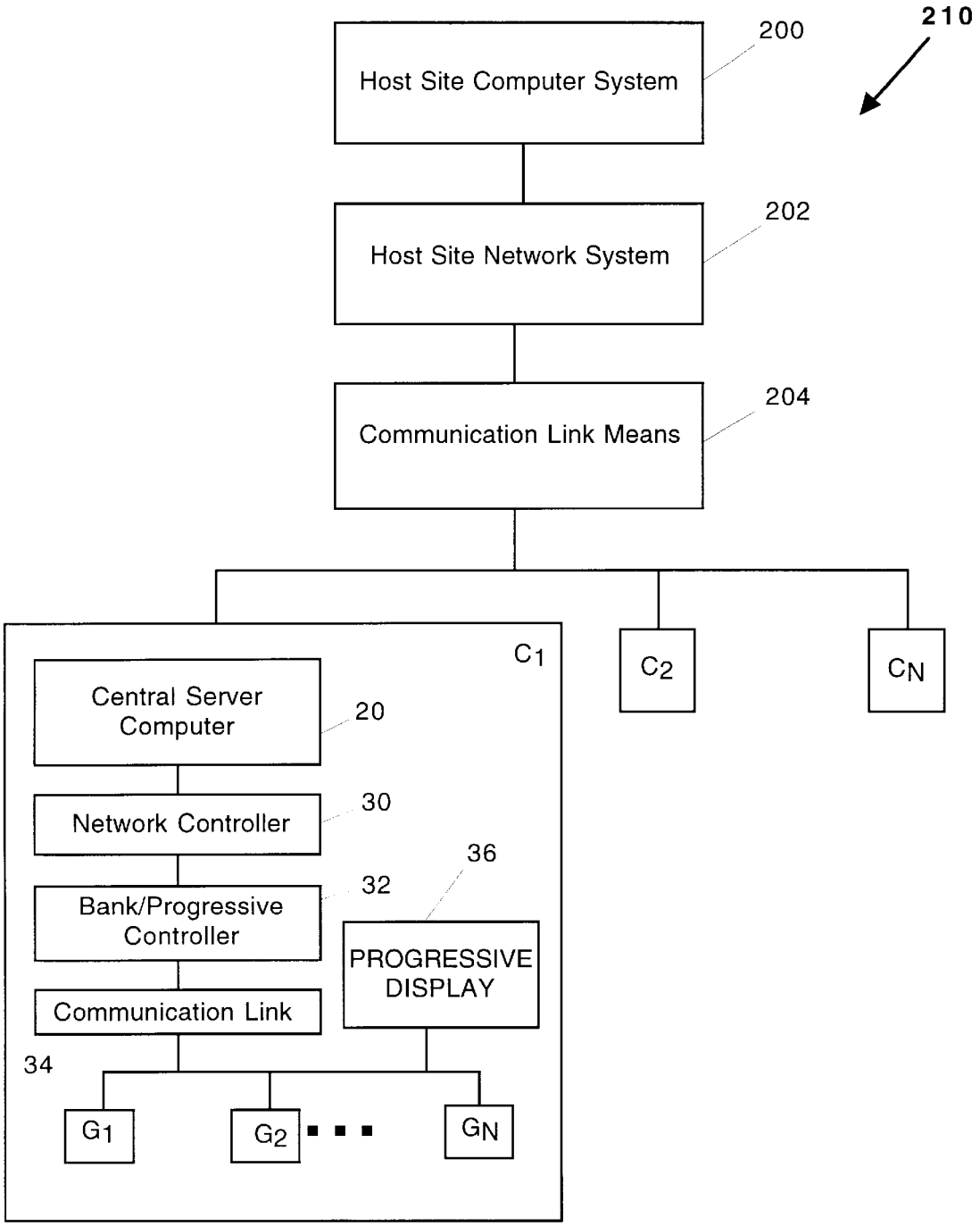
FIG. 3 is a schematic depiction of a multi-site progressive automated tournament gaming system according to one form of the instant invention.

Referring to FIG. 3, the system 10 includes a host site computer 200 operatively coupled to the plurality of central servers 20 at a variety of remote gaming or casino sites $C_1$, $C_2 \ldots C_N$ for providing a multi-site progressive automated tournament gaming system 210. The multi-site system 210 is integrated into the system 10 to increase the winnings, progressive amounts and the total buy-in.

Preferably, the host site computer 200 will be maintained for the overall operation and control of the system 210. The host site computer 200 includes a computer network 202 and a communication link means 204 provided with a high-speed modem for each individual casino site $C_N$.

Each casino site $C_N$ includes the central server 20 provided with a network link means 24 which includes a high-speed modem operatively coupled thereto. Bi-directional communication between the host site computer 200 and each casino site central server 20 is accomplished by the set of modems transferring data over dedicated communication lines.

A network controller 30, a bank controller 32 and a communication link 34 are interposed between each central server 20 and the plurality of attached gaming machines $G_1$, $G_2 \ldots G_N$ at each casino site $C_N$. In addition, the network controller 30, the bank controller 32 and the communication link 34 are interposed between each central server 20 and a progressive meter display 36 at each casino site $C_N$. Preferably, a tricolor LED system will be used for each progressive meter display 36 which may be housed in an interior casino sign. However, the system may include means to loop-back progressive data for in-machine progressive meters which fits top award insert areas on many popular games manufactured by the industry's leaders. The progressive meter 36 preferably displays progressive jackpots with dynamic odometer effects, text messages and player attracting animation.

Figure 4:
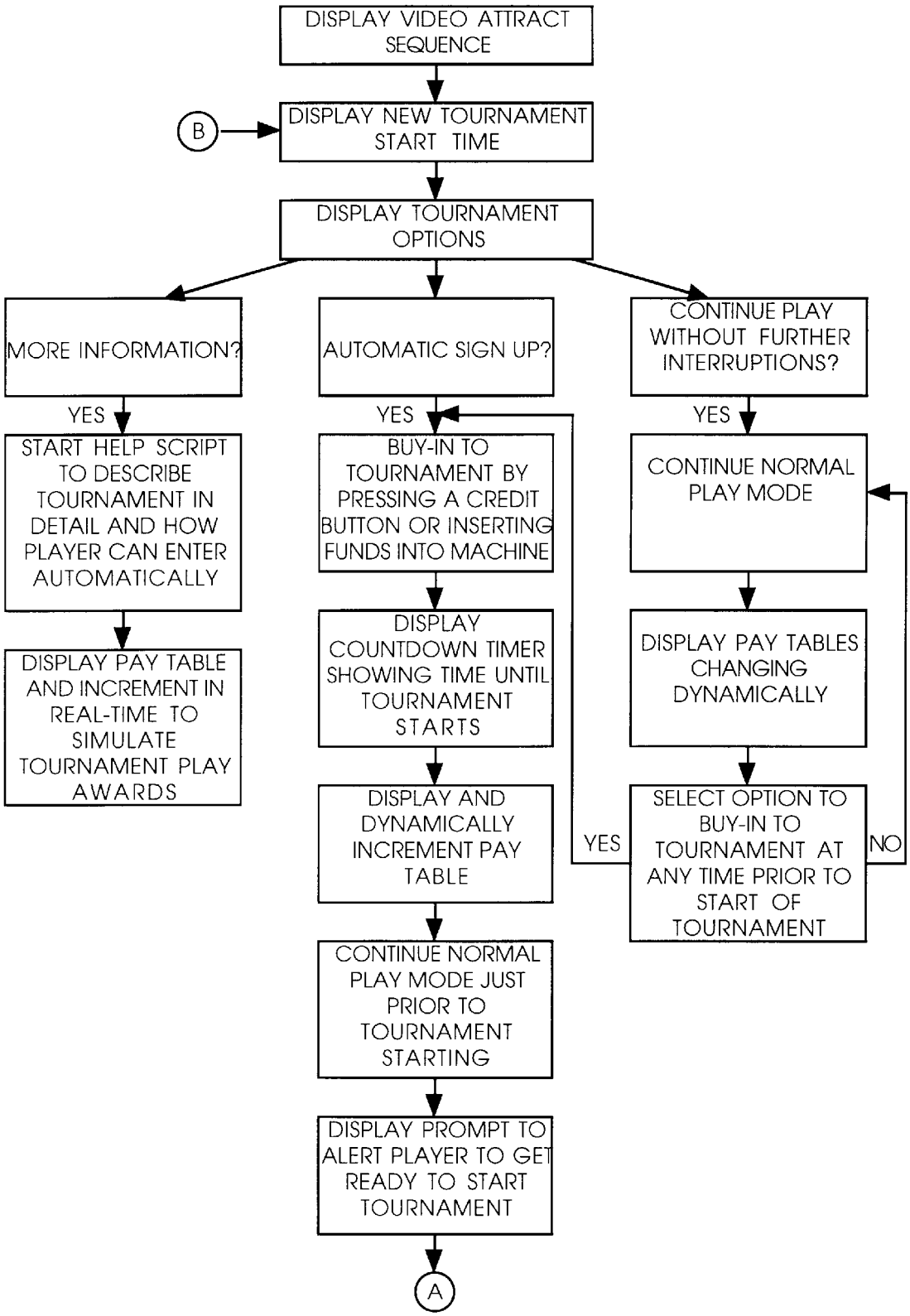
FIGS. 4 and 5 are flow diagrams of one operational method of play of the instant invention.

In use and operation, and referring to FIGS. 1, 2 and 4, the automated tournament gaming system 10 displays a video attract sequence on a display means 108 which include the video display 118, the active display 120 and the second video display 122 of each gaming machine $G_N$ respectively. The display means 108 displays attract sequences, tournament start times and tournament options. In addition, the countdown timer 110 dynamically displays the time remaining until the start of the next tournament.

Referring to FIG. 4, the video attract sequences provide the player with a plurality of tournament options which include the following: an option to obtain detailed information on tournament play, information on how the player can automatically sign up for the tournament immediately while still being allowed to play the default mode of the gaming machine until the countdown timer 110 has counted down the time until the next tournament starts and an option to allow the player to continue playing without further interruptions. While the video attract sequences are displayed to the players a paytable 130 is displayed which changes between a normal play mode pay out and an incentive tournament play mode pay out upon request or start of a tournament.

In one scenario, a player would approach a gaming machine $G_N$ and actuate a request button means 140 (please see FIG. 2) on the gaming machine $G_N$ for requesting further detailed information on the tournament play. The request button means 140 may be a delineated area on the touch screen display or a button or the like on the gaming machine $G_N$. The actuation of the button means 140 initiates the start of a help script which would further delineate the detail of tournament play and also would describe how the player can enter the tournament automatically and directly from the gaming machine $G_N$. Simultaneously, the paytables 130 are dynamically incremented between the normal game mode and the incentive tournament game mode for "selling" the player on buying into the excitement of the tournament.

More specifically, when the request button means 140 is actuated the signal travels to the controller assembly 80 and up to the processor assembly 100 and is then routed to the central server 20 which then responds by playing a detailed information script on the machine $G_N$ (please see FIG. 1). The processor assembly 100 includes a serial communication port thereby allowing the gaming machine $G_N$ to talk directly to the processor for requesting video feedback. In addition each gaming machine $G_N$ includes memory means 102 for storing scripts of information that store the video attract sequences, the tournament start times and the tournament options. The system 10 includes means for downloading to each said memory means 102 different attract sequence scripts from the central server 20 wherein the different sequence scripts are maintained in the gaming memory means 102 and are directly actuated by processor assembly 100.

Next, the player would pay for the tournament by means provided by the gaming machine, for example, pressing a credit button 134 (if there is enough credits on the credit meter) or inserting funds into a bill or coin validator 136, 138 respectively. Once the player has bought into the tournament, the countdown timer 110 displays and counts down the time remaining until the next tournament starts. The display means 108 displays the top awards for the winners of the tournament. Note, that the top awards preferably increment in real time to add to the excitement of playing in a tournament.

In the minutes just prior to the tournament starting, the game will remain in a normal play mode so that the player may continue to enjoy the excitement of the game while waiting for the start of the next tournament and also to allow all machines to operate at full productivity. Seconds prior to the tournament starting, the player will be notified on the display means 108 to prepare himself for the start of the tournament. When the tournament starts the normal play mode credit meter 112 preferably switches to the tournament mode credit meter 112 and the hold percentage will change to the players favor further adding to the excitement of the game.

If the player decides to ignore the tournament messages the player will not loose any play time of the continual normal play mode.

Figure 5:
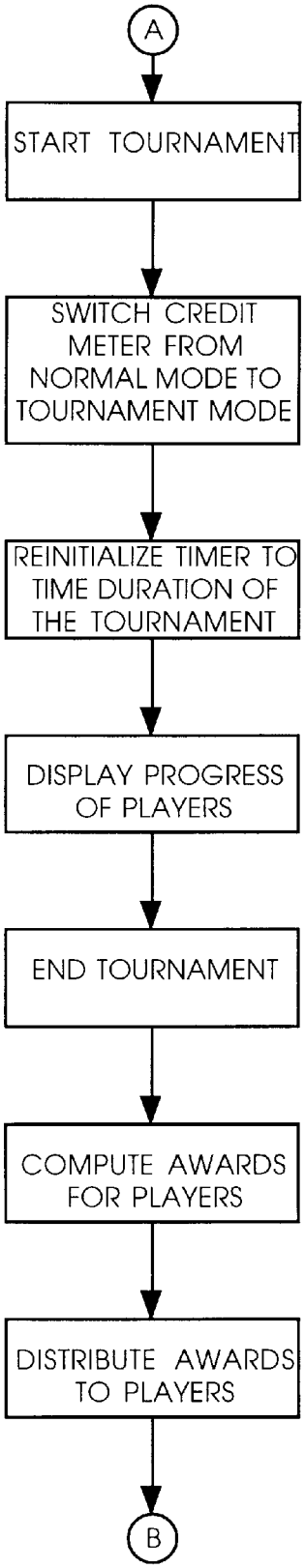

Referring to FIG. 5, once the tournament has started, the display 108 will indicate the progress of the player(s), which player(s) are in the top locations, and optionally, the player's name. Also, the winners are preferably displayed on an internal casino displays within the casino thereby showing winners in real time. Preferably, each gaming machine $G_N$ further includes a card reader assembly 140 operatively coupled to the controller assembly 80 for reading player cards. The card reader assembly 140 includes a card reading means 142, a keypad 144 and a card reader display means 146 (please see FIG. 2).

The system 10 also allows variations of the tournament play which can include team play, individual play and the like so that various groups, such as conventioneers can be teamed up for communal efforts or there can be a form of competition to stimulate the gaming experience.

The end of the tournament may be based upon a predetermined discrete amount of time, the number of handle pulls of the gaming machine or on the first player to achieve a certain amount of credits.

After the tournament is over, the tournament credit meter 112 on each enabled gaming machine $G_N$ will revert back to the normal mode credit meter 112 and the central server computer 20 computes all winners and awards and then distributes the awards to all winning players by providing prizes, game credits/or by direct payout. If the payout requires an IRS form W2G, the game preferably locks up and a signal is sent to the central server computer 20 for reconciliation.

Referring to FIGS. 3, 4 and 5 the system 10 further includes a host site computer 200 operatively coupled to the plurality of central servers 20 at a variety of remote gaming or casino sites $C_1$, $C_2$ . . . $C_N$ for providing a multi-site progressive automated tournament gaming system 210. The above delineated method of play is integrated into the multi-site system 210 to increase the winnings, progressive amounts and the total buy-ins.

The system 210 provides a secure and reliable real-time progressive system that is capable of operating on a variety of different manufacturers'makes and models of gaming machines $G_1$, $G_2$ . . . $G_N$. A tightly controlled host site computer 200 preferably oversees the entire system 210 and is the master for computing all jackpots. All participating casino sites $C_N$ report to, and receive information from, the host site computer 200 exclusively. Each central server 20 is responsible for, inter alia, all data communication between the casino hardware and software and the host site computer 200.

In addition, each group of attached gaming machines $G_1$, $G_2$ . . . $G_N$ at each casino site $C_N$ is operatively coupled to at least one bank controller 32 and preferably, at least one progressive meter display 36. Specifically, the network controller 30, the bank controller 32 and the communication link 34 are interposed between each central server 20 and both the plurality of attached gaming machines $G_1$, $G_2$ . . . $G_N$ and the progressive meter display 36 at each casino site $C_N$. In general, the bank controller 32 is responsible for polling data from the gaming machines $G_1$, $G_2$ . . . $G_N$, storing and validating that data, and exchanging data with the central server 20 which in turn communicates the data between the casino $C_N$ and the host site computer 200 which computes the progressive jackpot.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. An apparatus for tournament play for a plurality of gaming machines, comprising, in combination:

a controller, a processor, means coupling said processor and controller to said plurality of gaming machines, said gaming machines including means for receiving wagers and display means for indicating a random outcome, means for prompting potential players of the inception of a tournament, means for enabling said plurality of machines to assume a tournament mode, and further including a pay table display and means operatively coupled to said pay table display for dynamically changing the paytable between a normal mode and a tournament mode.

2. An apparatus for tournament play for a plurality of gaming machines, comprising, in combination:

a controller, a processor, means coupling said processor and controller to said plurality of gaming machines, means for prompting potential players of the inception of a tournament, and means for enabling said plurality of machines to assume a tournament mode, and including a pay table display and means operatively coupled to said pay table display for dynamically changing the paytable between a normal mode and a tournament mode.

3. A method for tournament play, the steps including:

prompting players of an upcoming tournament;

enrolling tournament players;

sequestering gaming machines selected by enrolled players for the tournament by converting the machine to tournament status;

playing the tournament;

concluding the tournament;

awarding prizes, and preventing the gaming machine from accepting tournament status, wherein prompting players of an upcoming tournament includes the step displaying video attract sequences on a display means disposed at each of the individual gaming machine, wherein prompting players of an upcoming tournament further includes the step of providing a countdown timer means and displaying and counting down the time until the start of the next tournament, and wherein prompting players of an upcoming tournament further includes the step of displaying tournament options on the display means wherein the tournament options displayed include an option for further tournament information, automatic sign up and continue play without further interruptions.

4. A method for tournament play, the steps including:

prompting players of an upcoming tournament;

enrolling tournament players;

sequestering gaming machines selected by enrolled players for the tournament by converting the machine to tournament status;

playing the tournament;

concluding the tournament;

awarding prizes, and preventing the gaming machine from accepting tournament status, wherein prompting players of an upcoming tournament further includes the step of displaying tournament options on the display means wherein the tournament options displayed include an option for further tournament information, automatic sign up and continue play without further interruptions.

5. The apparatus of claim 2 wherein said prompting means includes a display means for displaying tournament information including video attract sequences, tournament start time and tournament options.

6. The apparatus of claim 2 further including a countdown timer means for dynamically displaying a countdown of the time remaining until the tournament starts.

7. The apparatus of claim 2 further including a meter means for displaying normal game credits and means for switching the meter means to display tournament game credits at the start of the tournament and for switching the meter means back to display normal game credits at the end of the tournament.

8. The apparatus of claim 2 further including lock-in means for locking all tournament participating gaming machines into said tournament mode wherein participating players are precluded from cashing out of the tournament.

9. The apparatus of claim 2 further including lock out means for locking out all non-participating gaming machines from tournament play when the tournament has started.

10. The apparatus of claim 2 further including memory means operatively coupled to each said gaming machine and to said processor for storing attract sequence scripts including a help script and an advertisement script.

11. The apparatus of claim 2 further including means for downloading different attract sequence scripts from said central computer to said memory means wherein said different sequence scripts are maintained in said memory means.

12. The apparatus of claim 2 further including means for computing awards for players participating in the tournament.

13. The apparatus of claim 2 further including means for distributing awards to winning tournament players.

14. The apparatus of claim 2 further including a host site computer operatively coupled to a plurality of remote central servers each including the processor gaming machines via a progressive game processor and display means.

15. The apparatus of claim 2 wherein said progressive processor communicates with said plurality of gaming machines which are enabled for tournament play to allow players to contribute to and compete for at least one progressive jackpot displayed on said progressive display.

16. The method of claim 4 wherein prompting players of an upcoming tournament includes the step displaying video attract sequences on a display means disposed at each of the individual gaming machine.

17. The method of claim 4 wherein prompting players of an upcoming tournament further includes the step of providing a countdown timer means and displaying and counting down the time until the start of the next tournament.

18. The method of claim 17 wherein prompting players of an upcoming tournament further includes the step of displaying tournament options on the display means wherein the tournament options displayed include an option for further tournament information, automatic sign up and continue play without further interruptions.

19. The method of claim 3 wherein enrolling tournament players includes the steps of selecting the automatic sign up option, and buying into the tournament by placing a wager directly at the gaming machine.

20. The method of claim 3 further including the step of displaying a countdown timer showing the time until the tournament starts subsequent to the enrollment by the player.

21. The method of claim 3 further including the step of displaying and dynamically incrementing a pay table from a normal play mode to a tournament play mode subsequent to enrollment by the player.

22. The method of claim 2 further including the step of prompting the player to prepare for the next tournament just prior to the start of the next tournament.

23. The method of claim 3 wherein concluding of the tournament includes the step of counting the number of handle pulls of each of the gaming machines and concluding the tournament when a predetermined number of handle pulls has been obtained on at least one gaming machine.

24. The method of claim 3 wherein concluding the tournament includes the step of counting up to a predetermined discreet amount of time from the start of the tournament and then concluding the tournament when the discreet amount of time has elapsed.

25. The method of claim 3 wherein concluding the tournament includes the step of counting a discreet amount of time between the start and the end of the tournament and based upon that discreet amount of time concludes the tournament.

26. The method of claim 3 wherein concluding the tournament includes the step of monitoring the gaming machines for a predetermined amount of credits and then concluding the tournament when the predetermined amount of credits is obtained by at least one player.

27. A method for tournament play, the steps including:

prompting and enrolling tournament players into the tournament directly from at least one gaming machine;

sequestering gaming machines selected by enrolled players for the tournament by converting the machine to tournament status;

changing the paytable on all sequestered gaming machines;

playing the tournament;

ending the tournament when a predetermined variable has been obtained;

awarding prizes to all winning participating tournament players at the end of the tournament wherein prompting players of an upcoming tournament further includes the step of displaying tournament options on the display means wherein the tournament options displayed include an option for further tournament information, automatic sign up and continue play without further interruptions.

* * * * *